US005681034A

United States Patent [19]

Noniewicz

[11] Patent Number: 5,681,034

[45] Date of Patent: Oct. 28, 1997

[54] FOLDABLE WORKTABLE

[75] Inventor: Zbigniew Noniewicz, Kempenich, Germany

[73] Assignee: Wolfcraft GmbH, Weibern, Germany

[21] Appl. No.: 785,380

[22] Filed: Jan. 21, 1997

Related U.S. Application Data

[63] Continuation of Ser. No. 299,629, Sep. 2, 1994, abandoned.

[30] Foreign Application Priority Data

May 28, 1994 [DE] Germany ..... 44 18 627.8
May 28, 1994 [DE] Germany ..... 44 18 688.6

[51] Int. Cl.[6] ..... B25B 1/02

[52] U.S. Cl. ..... 269/139; 269/212; 269/244; 269/900; 108/121; 108/131

[58] Field of Search ..... 108/121–123, 108/130–132, 125, 127; 269/139, 208, 212, 214–215, 244, 900, 901; 254/418, 420, 424

[56] References Cited

U.S. PATENT DOCUMENTS

| | | | |
|---|---|---|---|
| 1,532,840 | 4/1925 | Slama | 108/121 |
| 2,144,049 | 1/1939 | Forcier | 108/132 |
| 2,769,650 | 11/1956 | Larson | 108/125 |
| 3,334,930 | 8/1967 | Larson . | |
| 3,554,141 | 1/1971 | Burr | 108/132 |
| 3,669,031 | 6/1972 | Cole | 108/132 |
| 4,061,323 | 12/1977 | Beekenkamp | 269/244 |
| 4,127,260 | 11/1978 | Hickman | 269/244 |
| 4,155,386 | 5/1979 | Alessio | 108/123 |
| 4,157,174 | 6/1979 | Hickman et al. | 269/244 |
| 4,310,150 | 1/1982 | Andrews | 269/139 |
| 4,617,869 | 10/1986 | Denomey | 108/121 |
| 4,909,491 | 3/1990 | Cheng | 269/16 |
| 5,065,989 | 11/1991 | Ho . | |
| 5,070,796 | 12/1991 | Maroné et al. | 108/130 |

FOREIGN PATENT DOCUMENTS

| | | |
|---|---|---|
| 0 068 258 | 1/1983 | European Pat. Off. . |
| 1 894 829 | 6/1964 | Germany . |
| 1 910 977 | 9/1969 | Germany . |
| 1 579 242 | 11/1980 | United Kingdom . |
| 2 190 618 | 11/1987 | United Kingdom . |

*Primary Examiner*—Robert C. Watson
*Assistant Examiner*—Thomas W. Lynch
*Attorney, Agent, or Firm*—Antonelli, Terry, Stout & Kraus, LLP.

[57] ABSTRACT

A working table fashioned as a clamping table includes a top frame supported by legs, with two plate-shaped clamping jaws or worktable portions being supported on mutually disposed frame members. One of the clamping jaws is adjustable with respect to the other clamping jaw by two adjusting spindles disposed in the frame members. To enable a more rapid clamping, provision is made that the other jaw is displaceably guided along the frame member and is equipped with locking pawls engaging locking holes provided in the frame member. The locking pawls are adapted to be lifted out of the locking holes by actuating members and are also lockable in an unlocked position.

21 Claims, 7 Drawing Sheets

FOLDABLE WORKTABLE

This application is a continuation of Ser. No. 08/299,629, filed Sep. 2, 1994, now abandoned.

FIELD OF THE INVENTION

The present invention relates to a foldable clamping worktable and, more particularly, to a foldable clamping table which includes two flat clamping jaws supported on a top frame having connected thereto downwardly diverging legs respectively connected by a coupling member and being articulated on a support member at different heights as well as being foldable in the same direction against the top frame, with a device for locking the table in a folded position and with a front or forward clamping jaw being adjustable with respect to a rear clamping jaw by a pair of adjusting spindles disposed in a pair of spaced frame members of the top frame.

BACKGROUND OF THE INVENTION

Clamping worktables of the aforementioned type, intended primarily for home craft persons, have been proposed in various constructions; however, the proposed worktables are very awkward to operate and usually include an expensive folding and locking mechanism.

In the proposed clamping worktable, workpieces of very different sizes can be clamped, with the provision often being made for enabling an adjusting of the forward clamping jaw or table portion diagonally to permit a clamping even of workpieces of very different shapes such as, for example, triangular workpieces. When changing between workpieces of very different shapes and/or sizes, the forward clamping jaw must be adjusted over a correspondingly large distance by adjusting spindles, which is time consuming and awkward and a similar time consuming adjustment is also required when, for example, clamping triangular workpieces, whereby, with such non-rectangular workpieces, the clamping possibilities are limited to the maximum possible diagonal position of the forward clamping jaw.

For example, in EP 0 068 258 A2, a worktable is proposed wherein two support legs joined by a coupling member form a four bar linkage, with the two legs being locked in the unfolded table position by locking an additional coupling member. A locking or unlocking of the additional coupling member is a tedious operation.

SUMMARY OF THE INVENTION

The aim underlying the present invention essentially resides in providing an inexpensively manufacturable folding table which is stable in the unfolded position and which is easy to operate when unfolding and folding by virtue of the provision of a compact folding and locking mechanism in addition to providing a clamping table which enables clamping operations to be effected more rapidly while expanding the possibilities of clamping irregularly shaped workpieces.

In accordance with the present invention, at an upper end area of at least one leg, a locking recess or depression is provided with a locking strip or locking portion being formed. The locking pin, secured to the top frame is accommodated in the locking recess or cavity and is prevented from being displaced therefrom by the locking strip or portion when the worktable is unfolded or opened. To enable this operation, the at least one leg is mounted so as to be displaceable in a longitudinal direction at a point of articulation for a distance at least equal to the height of the locking strip or locking portion such that the at least one leg is integrally lockable with a top frame by a clamping device such as, for example, a clamping lever.

In the worktable of the present invention, the articulation points on the top frame of the two legs joined together by a coupling member as well as devices for locking the table in an unfolded or open position can be arranged relatively near each other so that the articulation points and the locking devices can be arranged on a relatively small support part or member on the top frame thereby providing an economical and compact design.

A locking of the worktable in an unfolded position takes place in accordance with the present invention by the locking pin engaging the locking recess or depression of the at least one leg, with the locking pin precisely positioning the parts pivotable with respect to one another in the unfolded or open position, and with the open position being secured by the clamping lever. When the worktable is folded, the user is merely required to loosen the clamping lever and lift the top frame at one longitudinal end, whereby the legs then rest parallel to the top frame. To unfold or reopen the worktable, the user need only lift the top frame again along one longitudinal end, whereupon the legs swivel or pivot apart until the locking pin engages the corresponding locking recess or depression on the respective table legs. Then the unfolded or open position is secured by pivoting the clamping lever, with the operation or set up of the worktable being extremely simple.

It is important for the at least one leg having the locking recess or depression to be articulated and also to be longitudinally displaceable so as to create a four bar linkage which limits the movement required to overcome the height of the locking strip or locking portion.

In accordance with the present invention, provision may be made that the rear legs, articulated at a lower position, may have extensions extending beyond the articulation points on which locking depressions are formed. By this arrangement, the spaces above the articulation points of the rear legs that are integral with the top frame are used for mounting the locking pin and locking depression or recess thereby also permitting an especially compact design.

Advantageously, in accordance with still further features of the present invention the top surface of the worktable is fashioned of two clamping jaws or table portions which are adjustable with respect to each other by a pair of manually operated spindle drives. The individual manually operated spindle drives enable a diagonal adjustability between the clamping jaws or worktable portions with respect to the spaced frame members.

According to the invention, the rear clamping jaw is displacably guided on the spaced frame members and is provided with locking pawls engageable in locking holes or slots in the spaced frame members, with the pawls being adapted to be lifted by actuating or operating members out of the locking holes or slots and being adapted to be secured in an unlocked position.

By virtue of the features of the present invention, when a workpiece is clamped, the rear clamping jaw can initially be moved in a rapid adjustment against the workpiece, so that the workpiece is always gripped firmly between the two clamping jaws or table portions prior to a tight clamping which is achieved by adjusting the forward clamping jaw by the adjusting spindle units. Thus, when changing between two workpieces having different sizes or configurations, the required time-consuming adjustment in the prior art constructions is avoided.

According to the present invention, the rear clamping jaw is diagonally adjustable with respect to the spaced frame members so that, with, for example, triangular workpieces, a rapid, course adjustment of the clamping jaws can be carried out prior to final clamping of the workpiece in place.

By virtue of the diagonal adjustability of the forward clamping jaw or table portion, the simultaneous diagonal adjustability of the rear clamping jaw or table portion offers the additional advantage that the clamping jaws or table portions can be aligned at an angle with respect to one another that is much greater and generally twice as great as the maximum adjustable angle in conventional clamping worktables.

In accordance with the present invention, the rear clamping jaw or table portion is secured with a radial play onto sliding blocks guided along the spaced frame members and is adjustable diagonally with respect to the spaced frame members.

The sliding blocks each engaged by a sleeve-shaped projection, a narrower part of the stepped bore of the clamping jaw that widens in an upward or vertical direction, with the radial play. A part of the stepped bore having the larger diameter receives a head of a mounting screw or bolt and possibly also a washer resting on a shoulder of the bore with radial play.

In order to further increase the possible applications of the clamping worktable of the present invention, provision can also be made for a set of clamping prisms to be associated with the clamping jaws or worktable portions, with the clamping prisms each being provided with a lower pin insertable in holes provided in the clamping jaws or worktable portions. Each of the clamping prisms include clamping sides for accommodating different workpiece shapes, for example, round or bent workpieces so that by using the clamping prisms, workpieces of nearly every conceivable shape can be firmly clamped in the worktable.

The above and other features and advantages of the present invention will become more apparent from the following description when taken in connection with the accompanying drawings which show, for the purpose of illustration only, one embodiment in accordance with the present invention.

DETAILED DESCRIPTION

Figure 1:
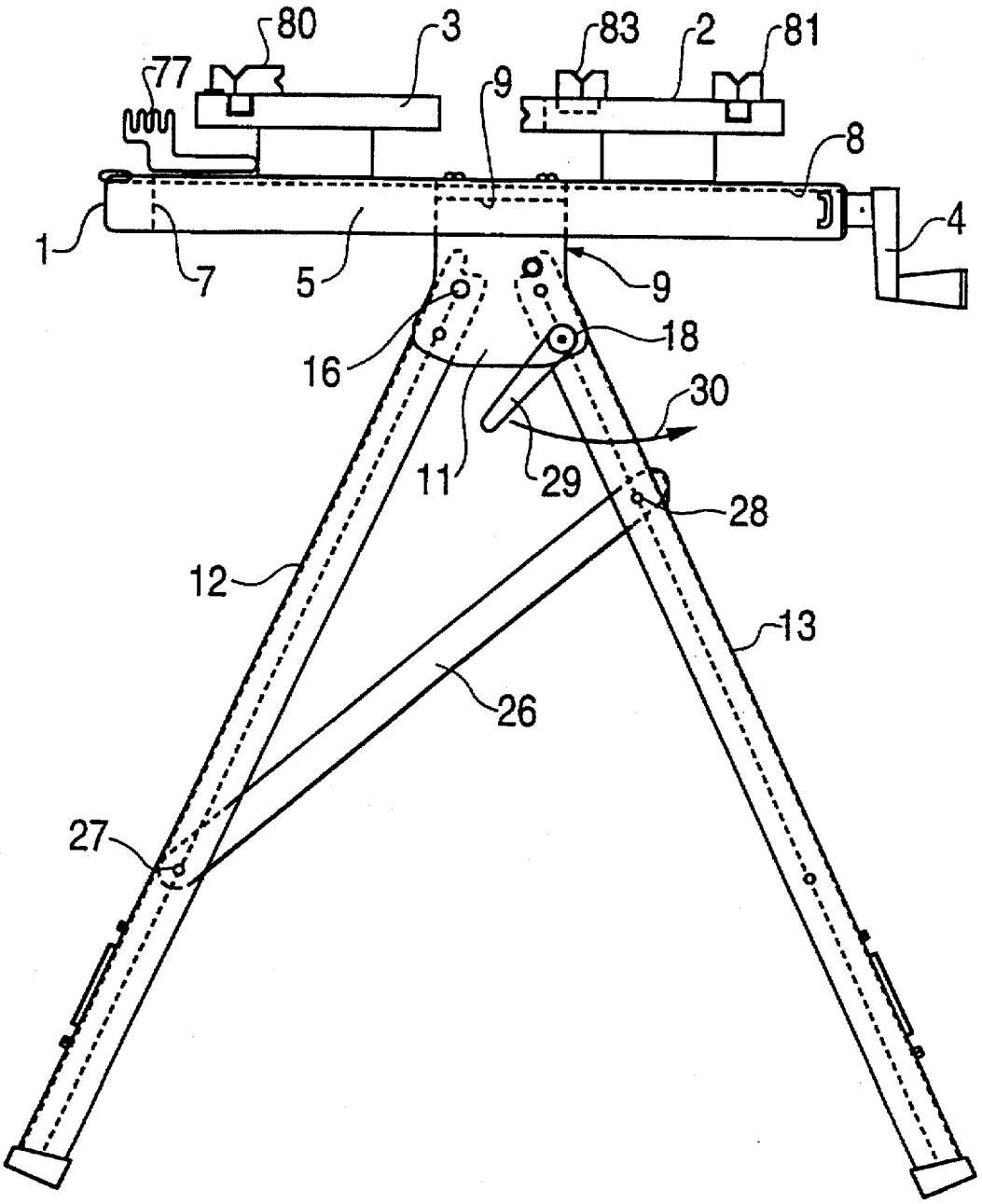
FIG. 1 is a side view of a clamping table constructed in accordance with the present invention.

Referring now to the drawings wherein like reference numerals are used throughout the various views to designate like parts according to these figures, in accordance with the present invention, a worktable, fashioned as a clamping table includes two clamping jaws or table portions 2, 3 supported on a top frame 1 comprising a pair of spaced side support or frame members 5, 6 connected by a cross member 7 so as to form a substantial U-shaped support member 9. The jaw or table portion 3 is fixed to a portion of the top frame 1, with the jaw or table portion 2 being displaceable toward and away from the jaw or table portion 3 by conventional spindle drives disposed in the respective support members 5, 6. The spindle drives are operable by, for example, hand cranks 4.

In the illustrated embodiment, the side support or frame members 5, 6 as well as the cross bar 7 have a substantially U-shaped profile; however, as can be appreciated, the members 5–7 may be constructed as closed channels having a rectangular configuration. The U-shaped support member 9 is fixed to a bite portion or a wall 8 of the respective support or frame members 5, 6 substantially at a center or mid portion of the respective members 5, 6. The U-shaped support member 9 includes includes a pair of supports 10, 11 adapted to receive upper ends of pairs of worktable legs 12, 13 and 14, 15. The articulation of the upper ends of the respective pairs of worktable legs 12, 13 and 14, 15 are identical on the opposite sides of the worktable and, consequently, the following description would be limited to the pair of legs 12, 13.

Figure 5:
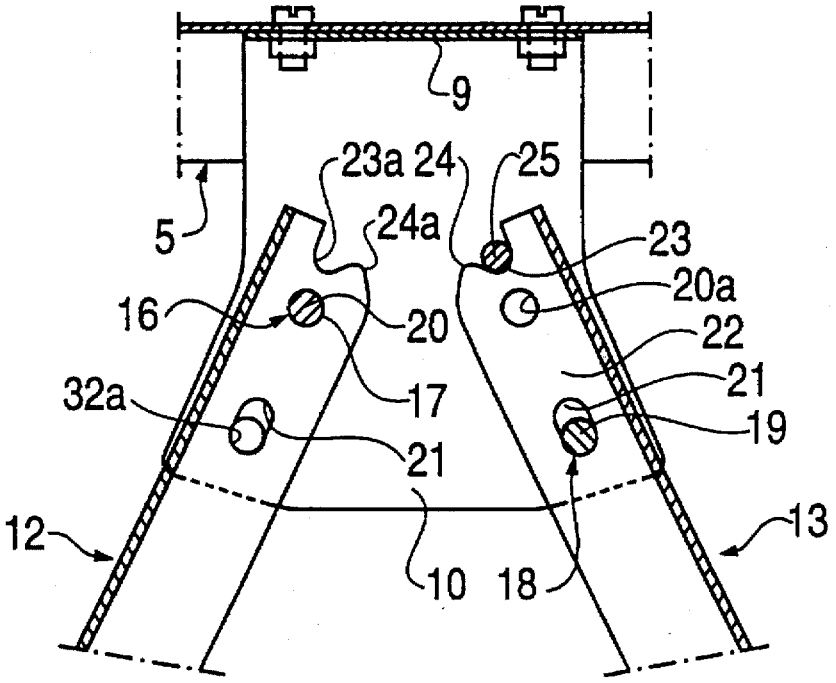
FIG. 5 is an enlarged detail view of the locking arrangement of the clamping table of the present invention.

As shown in FIG. 5, the upper end of the leg 12 is pivotally mounted at an articulation point generally designated by the reference numeral 16 by a suitable fastener 17 such as, for example, a pin or threaded nut and bolt arrangement. The fastener 17 is supported in suitable aligned openings provided in the supports 10, 11.

Figure 6:
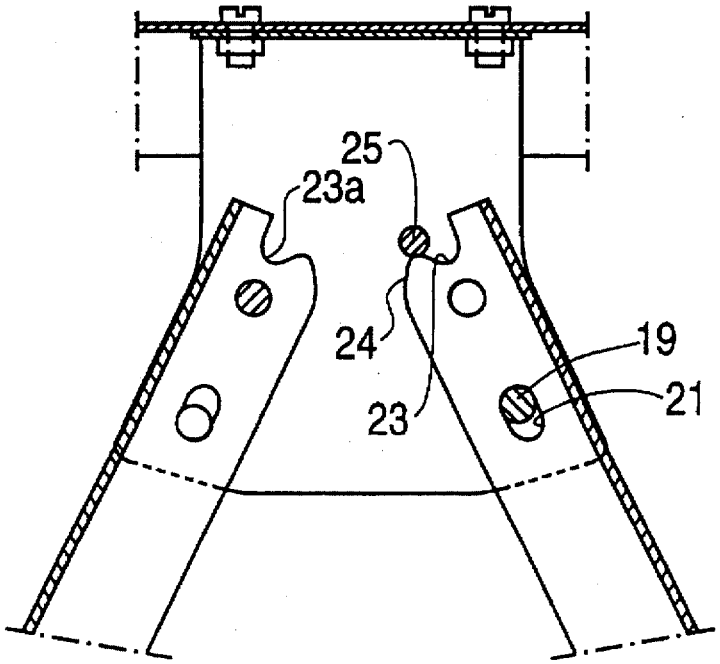
FIG. 6 is a cross-sectional view, on an enlarged scale of the position of the legs of the clamping table in an unlocked position.

The leg 13, as shown in FIGS. 5 and 6, is pivotally mounted at a lower articulation point generally designated by the reference numeral 18 by a suitable fastener 19 such as, for example, a pin or nut and bolt arrangement. The fastener 19 is supported in suitable aligned openings provided in the supports 10, 11 of the U-shaped support member 9 and in the pairs of legs 12, 13, 14 and 15. The worktable legs 12, 13 as well as the worktable legs 14, 15 have a U-shape cross section opening in a direction facing one another. The fasteners 17, 19 pass through both side legs of the U-shaped worktable legs 12, 13 with the fastener 17 being accommodated in a round bearing opening 20 (FIG. 5) and the fastener 19 being accommodated in an elongated hole 21 (FIGS. 5, 6). The worktable leg 13 and corresponding oppositely disposed worktable leg 15 each include an extension portion 22 (FIG. 5) projecting beyond the articulation point 18. A locking recess or depression 23 including a locking portion 24 is provided at the upper end of the extension portion 22. When the worktable is completely unfolded or in an open position, the locking pin 25 is accommodated and locked in the recess or depression 23 by the locking portion 24. The locking pin 25 extends through the 13 and supports 10, 11 of the U-shaped support member 9.

The pairs of worktable legs 12, 13 and 14, 15 are coupled to each other by a coupling member 26 fashioned, for example, as a U-shaped member opening in a downward direction. The four areas or portions between the articulation points of the respective pairs of the worktable legs 12, 13 and 14, 15 define or form a four bar linkage with an additional degree of freedom or freedom of movement being provided by the provision of the elongated hole 21 provided in the worktable legs 13 and 15. The elongated hole 21 is dimensioned so as to permit a longitudinal displacement of the worktable legs 13 and 15 at least by a distance equal to a locking height of the locking portion 24 as shown most clearly in FIG. 6. The clamping lever 29 is pivoted about the fastener 19, with the clamping lever 29 being pivoted to lock the worktable legs 13 and 15 in position and, consequently, defining the four bar linkage in the unfolded position.

The clamping lever 29 may be of a conventional construction and, instead of the clamping lever 29, a clamping nut (not shown) could also be provided with the clamping nut being constructed as a handle and bolted or otherwise secured onto one end of the fastener 19 which may be provided with a threaded portion.

Figure 7:
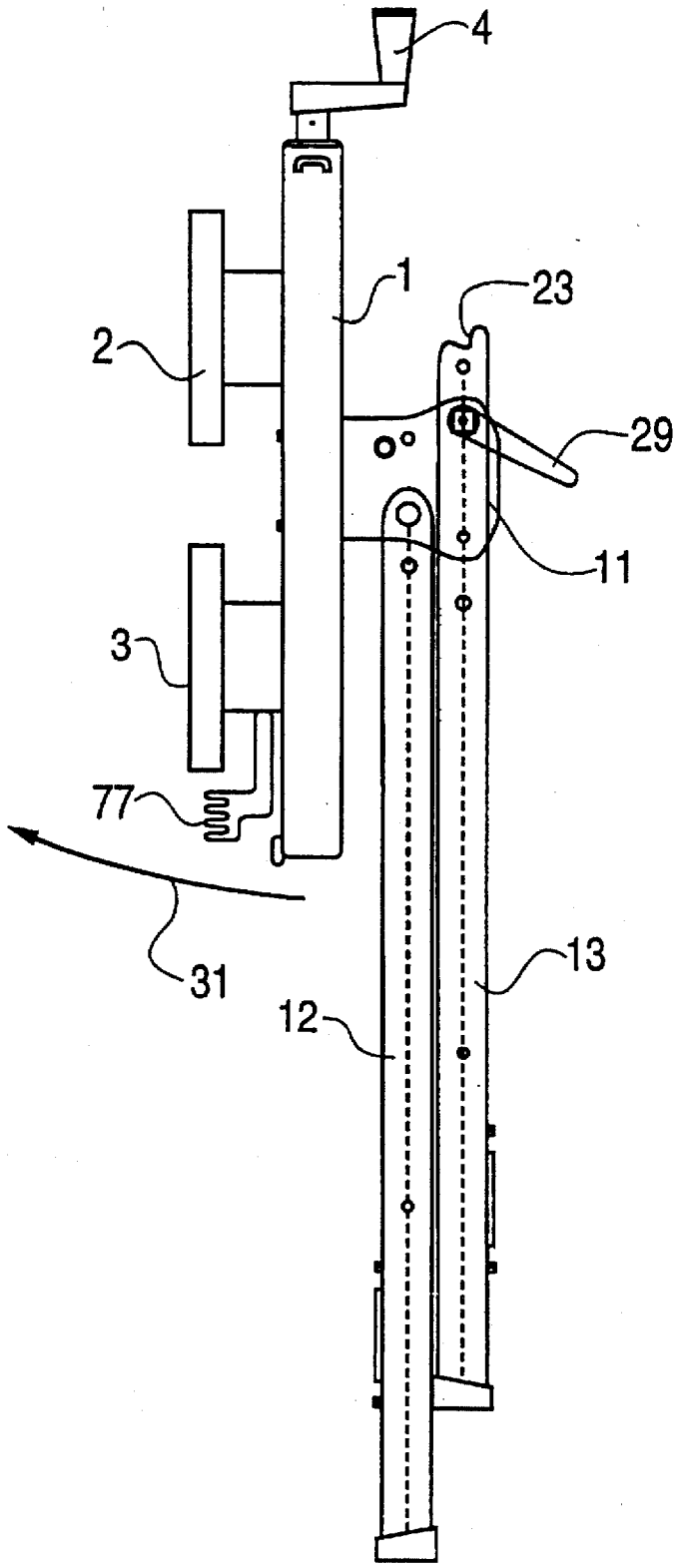
FIG. 7 is a side view of the clamping table in a folded position.

When the table is to be folded up from the position shown in FIG. 1, the two clamping members 29 are pivoted about 90° in a direction of the arrow 30 in FIG. 1 thereby releasing the lock. Then the top frame 1 is raised at its end at the right in FIG. 1 and then the locking pin 25 is raised out of the locking cavity 23 (FIG. 6). When the top frame is lifted further, it becomes perpendicular to the worktable legs 12, 13 and 14, 15 passing through the position shown in FIG. 7 in which the worktable legs 12, 13 and 14, 15 are aligned parallel with the top frame and finally abut the top frame. When the worktable is unfolded, the top frame 1 is lifted at its lower end or pivoted upward in a direction of the arrow 31 until the locking pin 25 engages in the locking recess or depression 23, whereupon the unfolded position is established in advance. The clamping lever 29 is then swung backward to finally lock the table in the unfolded position. In FIG. 1, the lever 29 is illustrated in a locking position in which it therefore locks the table in its folded state. As apparent, prior to unfolding the table, it is necessary to first pivot the clamping lever 29 into a released position. Thus, the clamping levers 29 may therefore be used to secure both the folded and unfolded positions which is especially advantageous both in operation and in terms of manufacturing costs.

As shown most clearly in FIG. 5, both legs 12, 13 have an identical configuration for the sake of efficiency; however, the round hole or opening 20*a* of leg 13 and the elongated hole 21*a*, locking cavity 23*a* and locking strip 24*a* of the worktable leg 12 are not utilized. The elongated hole 21*a* in the worktable leg 12 and round hole 32*a* in the support legs 10, 11 of the support member 9 can be used to accommodate a safety pin in order to additionally secure the worktable in an unfolded position.

Figure 4:
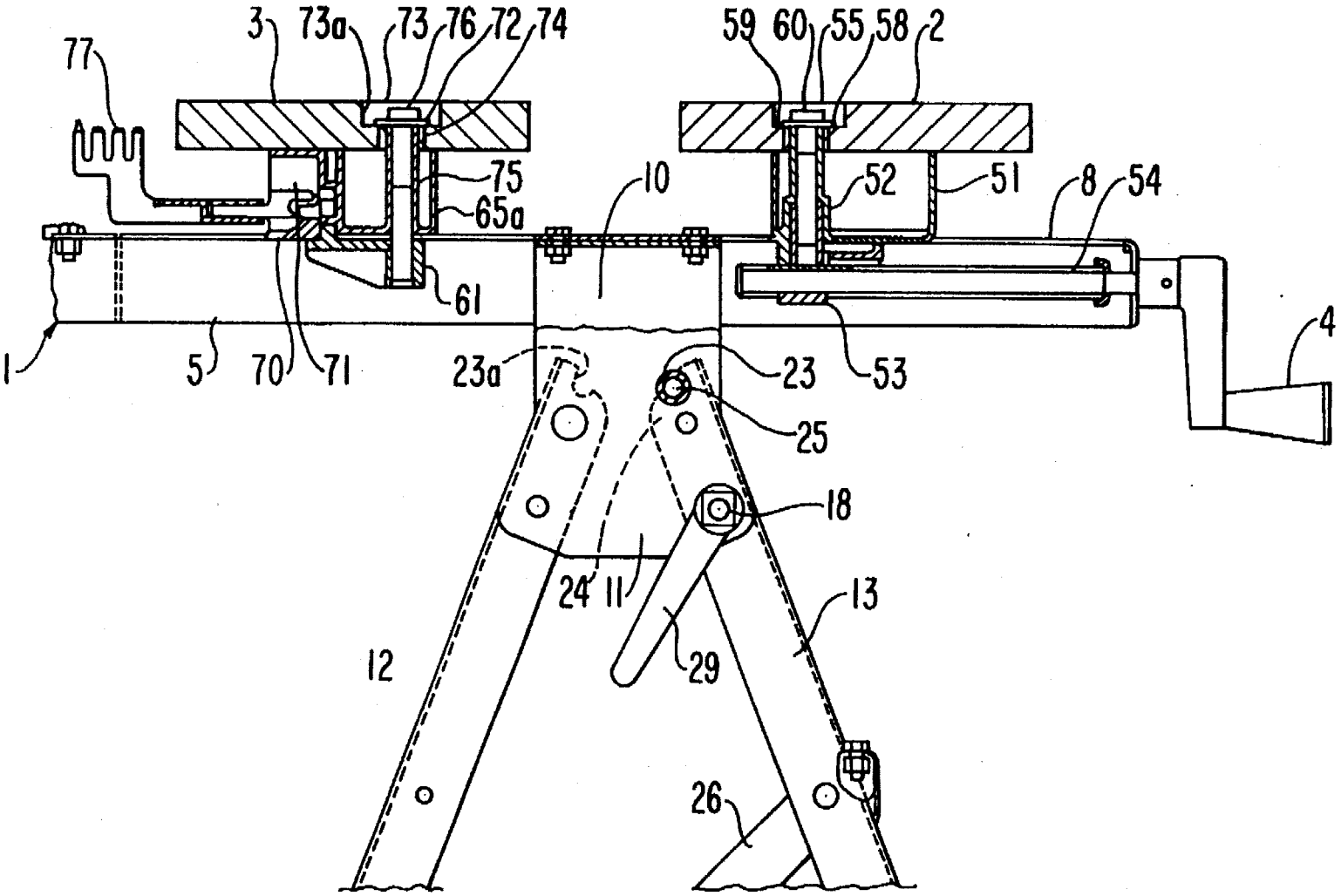
FIG. 4 is a partial longitudinal cross-sectional view of the clamping table of the present invention.

The clamping jaw or worktable portion 2 is supported at respective sides by sliding blocks 51, only one of which is shown in FIG. 4, so as to enable the clamping jaw or worktable portion 2 to be displaceable along the respective members 5, 6. A spindle nut 53 of the respective spindle drives includes a sleeve-shaped engaging pin 52 engageable with respective sliding blocks 51. The respective spindle nuts 53 are adjustable by an adjusting spindle 54 through the hand crank 4. The clamping jaw or worktable 2, sliding block 51 and spindle nut 53 are held together by a screw 55 threaded into the engaging pin 52 provided with an internal thread. The bite or upper wall portion 8 of the members 5, 6 include a longitudinally extending slot 57 through which the pin 52 and screw 55 pass. The spindle nut 53 and the sliding block 51 are made sufficiently wide so that they can grip the longitudinal edges of the slot 57 in a conventional manner. A head of the screw 55, with the washer 58, rests on a shoulder 59 of a stepped hole 60 formed in the clamping jaw 52. The stepped hole 60 accommodates the washer 58 and the sleeve-shaped engaging pin or projection 52 of the sliding block 51 with radial play such that the clamping jaw or worktable portion 2 is also diagonally adjustable with respect to the members 5, 6.

Figure 4A:
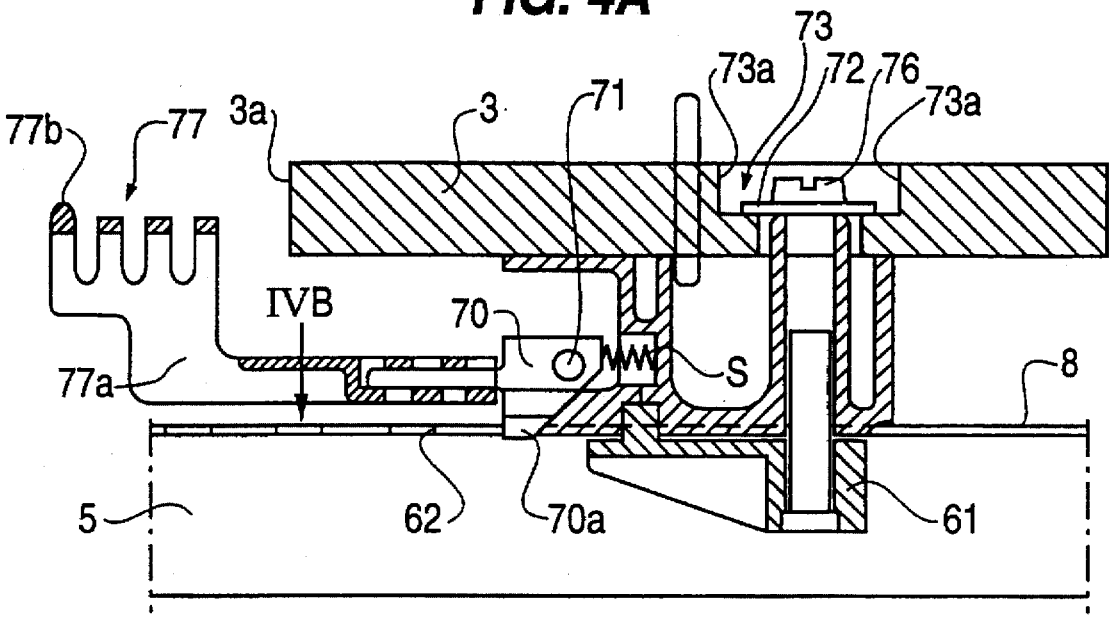
FIG. 4A is a partial cross-sectional detailed view, on an enlarged scale, of a locking pawl and detent arrangement for one of the clamping jaws or worktable positions of the worktable constructed in accordance with the present invention.
Figure 4B:
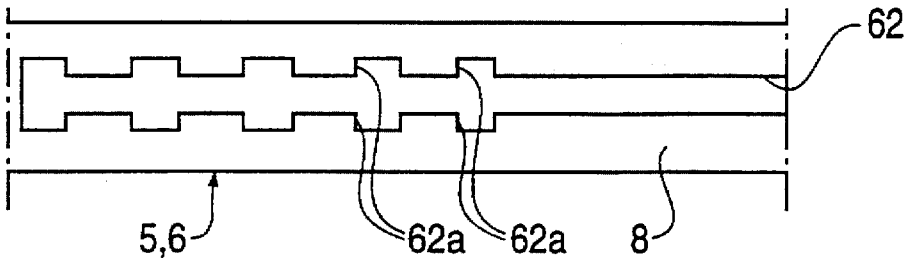
FIG. 4B is a schematic view, on an enlarged scale of a portion of a slot provided in a support area for the clamping jaw or worktable portion as viewed in the direction of the arrow IVB in FIG. 4A.

The rear clamping jaw or worktable portion 3 is similarly displaceably supported on the bite or upper wall portion 8 of the members 5, 6, with a counter element 61 being located within the members 5, 6 to which the clamping jaw or worktable portion 3 and a sliding block 61*a* are fastened by a cap screw 76 engaging the bite or upper wall portion 8 of the members 5, 6, provided with a longitudinal slot 62 (FIG. 4A). A sleeve-shaped projection 75 of the sliding block 61*a* and a washer 72 of a cap screw 76 are accommodated in a stepped hole 73 with a relatively large radial play with the wider diameter portion 73*a* of the stepped hole 73 receiving the washer 72 and a narrower portion 74 of the stepped hole 73 accommodating the projection 75 with radial play so that the rear clamping jaw or worktable portion 3 is likewise adjustable diagonally.

A locking pawl 70 is mounted so as to be pivoted around a horizontal axis 71 in each of the sliding blocks 61*a* of the clamping jaw or worktable portion 3, with suitable handles or grip portions 77 being provided to facilitate pivoting of the locking pawl 70.

As shown in FIG. 4A, in an area of the rear clamping jaw or worktable portion 3, the bite or upper wall 8 of the members 5, 6 is provided with an elongated slot 62 having a plurality of indentations or notches 62*a* which are adapted to receive the locking pawl 70 thereby enabling the rear clamping jaw or worktable portion 3 to be fixed at a number of positions either diagonally with respect to the clamping jaw or worktable portion 2 or parallel to the opposed face of the clamping jaw or worktable portion 2.

In each sliding block 61*a* of the rear clamping jaw or worktable portion 3, a locking pawl 70 is provided and is mounted to pivot around a horizontal axis 71 with the pawl 70 engaging locking serrations of notches 62*a* of the frame or support members 5, 6 and with the pawl 70 having a relatively wide pawl nose 70*a* and being tensioned by a return spring S in the engagement direction.

The actuating member 77 is permanently connected with each pawl 70, with each of the actuating members 77 being fashioned as a manual lever extending below the rear clamping or worktable portion 3 to a position behind a rear end surface 3*a* of the clamping jaw or work portion 3. The respective actuating members 77 have a bent grip portion terminating in a grip portion 77*b* enabling a gripping by a finger of a user of the worktable. In both support and frame members, the pawl can be lifted out of the locking serrations or notches 62*a* by the grip portions 77*b* and secured in an unlocked position, where upon the clamping jaw or worktable portion 3 can be slid in a rapid adjustment against the respective workpiece to be clamped and, if necessary, a diagonal adjustment of the rear clamping jaw or worktable portion can be performed.

Figure 2:
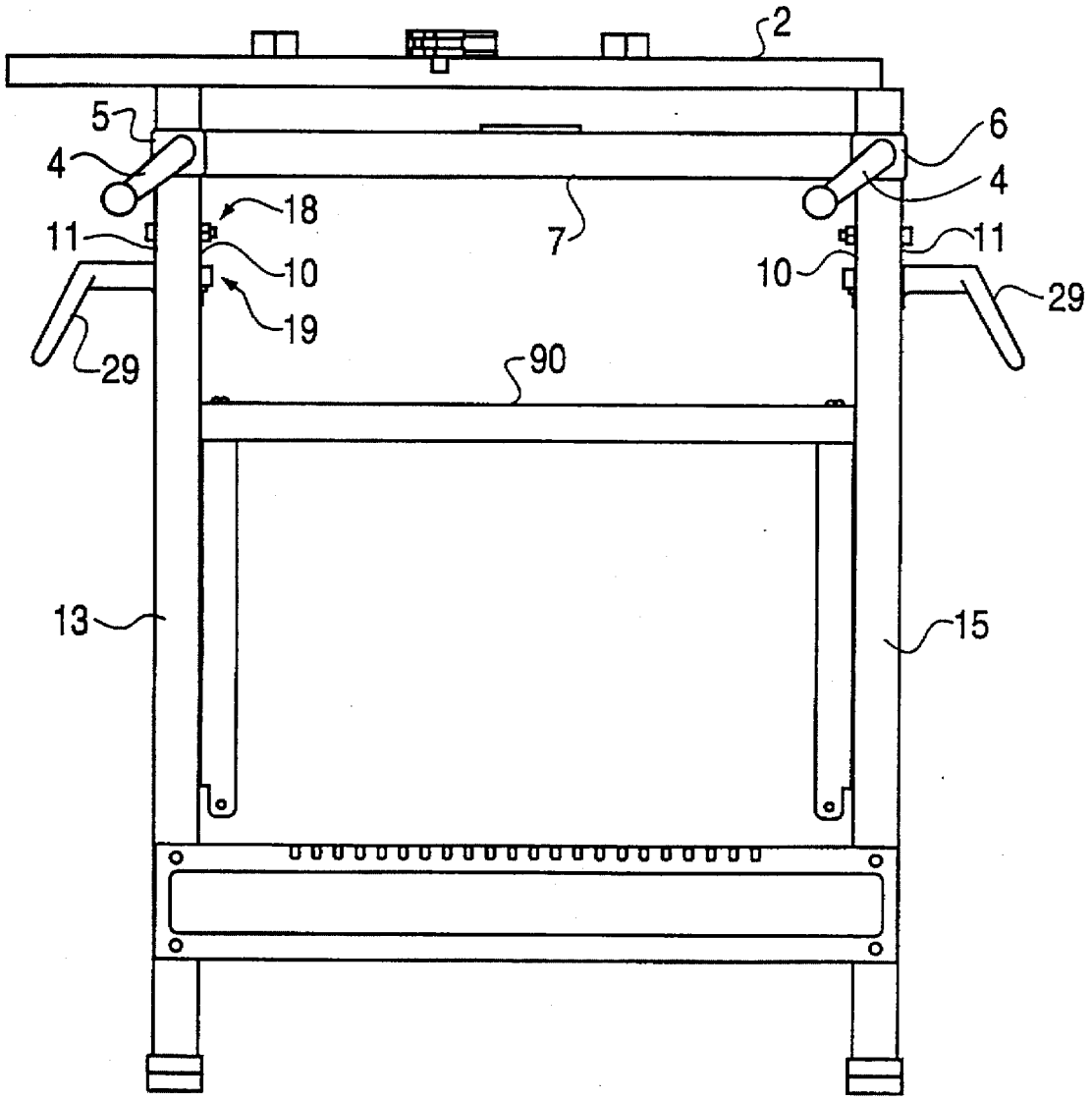
FIG. 2 is a side view of the clamping table of the present invention as viewed from the right side in FIG. 1.
Figure 3:
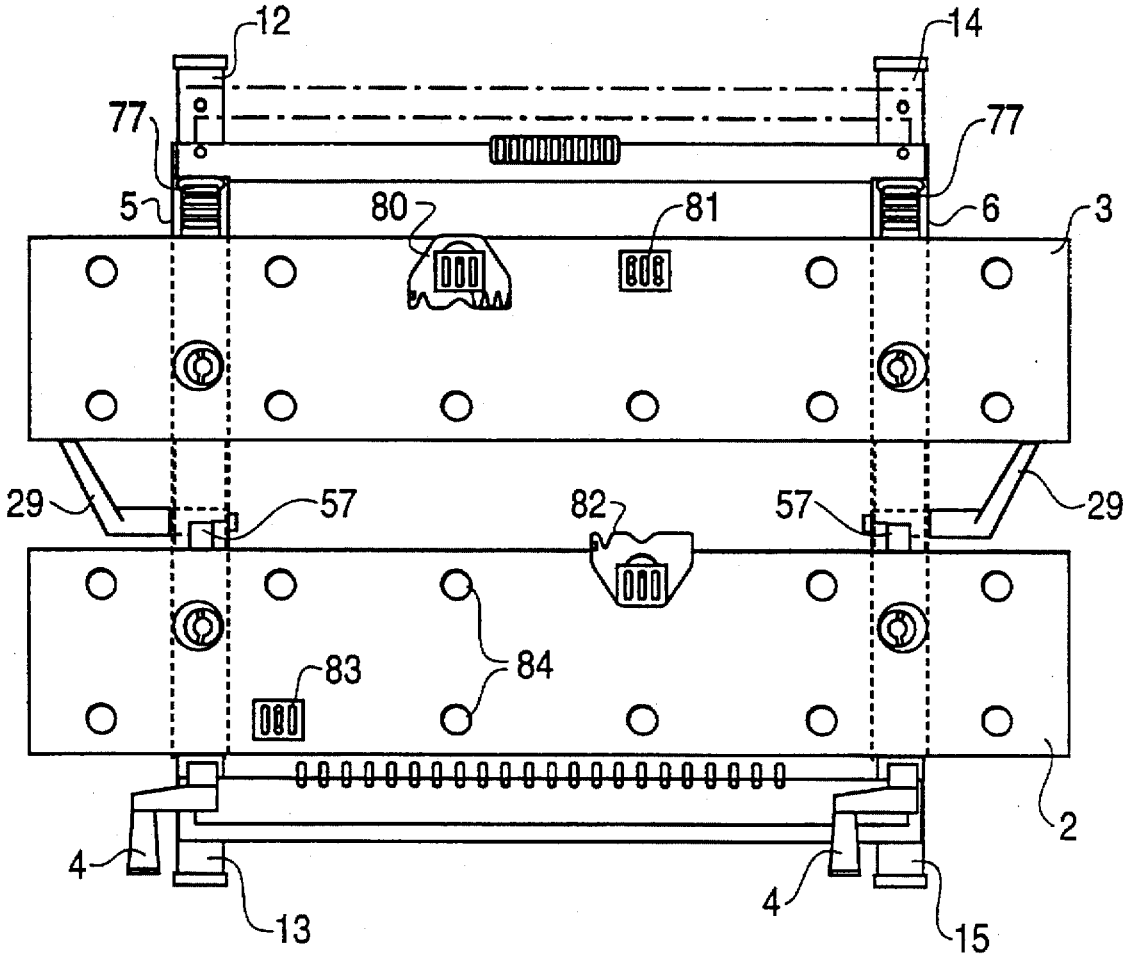
FIG. 3 is a top view of the clamping table of the present invention.

As shown in FIGS. 1 and 3, to further enhance the versatility of the worktable of the present invention, the clamping jaws or worktable portions 2, 3 may be provided with a plurality of openings or holes 84 for accommodating, for example, additional clamping prisms or units 80, 81, 82, 83, 84 for accommodating differently shaped workpieces thereby enabling virtually every shape of workpiece to be firmly clamped. Additionally, a further cross bar 90 (FIG. 2) can be provided with spaced openings (not shown) to accommodate the clamping prisms or units 80–83 when not in use or to accommodate other tools such as, for example, screw drivers, chisels, wrenches or the like.

While I have shown and described only one embodiment in accordance with the present invention, it is understood that the same is not limited thereto but is susceptible to numerous changes and modifications as known to one of ordinary skill in the art, and I therefore do not wish to be limited to the details shown and described herein, but intend to cover all such modifications as are encompassed by the scope of the appended claims.

I claim:

1. A foldable worktable comprising a top frame, and a pair of clamping members mounted on said top frame, said top frame including a pair of locking pins and a pair of spaced frame members disposed substantially parallel to one another and connected by a cross member, two pair of pivotally mounted downwardly diverging legs coupled to the top frame to enable each pair of legs to be pivotable in an identical direction relative to the top frame, at least one leg of each pair of legs having a locking arrangement including a recess which opens toward an underside of the top frame when the worktable is in an unfolded position and an extension which extends from the recess in a longitudinal direction along the at least one leg toward the underside of the top frame when the worktable is in an unfolded position, each recess accommodating a different one of the locking pins to lock the worktable in the unfolded position, the locking pins moving in association with the pivoting of the top frame relative to the pairs of legs to and from the unfolded position and said at least one leg of each pair of legs is displaceable in the longitudinal direction away from the top frame when the worktable is in the unfolded position so as to enable an unlocking of the locking arrangement by pivoting the top frame and each locking pin relative to the pair of legs to clear the pair of locking pins from being accommodated in the recess and to clear the locking pins from the extension when the worktable is in the unfolded position to permit the worktable to be folded.

2. A foldable worktable according to claim 1, wherein a clamping device clamps the frame in a fixed position relative to a pair of the two pairs of legs to permit locking of the worktable in the unfolded position.

3. A foldable worktable according to claim 2, wherein the clamping device includes a clamping lever pivotally mounted so as to be displaceable between an open and closed position.

4. A foldable worktable according to claim 3, wherein the respective pairs of legs are attached to a support member which is attached to the top frame in proximity to a vicinity of a mid portion of the respective frame members.

5. A foldable worktable according to claim 4, wherein said support member is a U-shaped member mounted on the respective frame members so as to open in a downward direction.

6. A foldable worktable according to claim 5, wherein said locking pin is fastened to legs of the U-shaped member.

7. A foldable worktable according to claim 1, wherein each of the clamping members comprises a worktable portion including a working surface, at least one of said worktable portions is adjustably mounted along the frame members so as to enable a clamping of a workpiece between opposed edges of the worktable portions.

8. A foldable worktable according to claim 7, wherein said at least one worktable portion is mounted on a pair of sliding blocks respectively accommodated in a slot provided in the respective frame members.

9. A foldable worktable according to claim 8, wherein a drive is provided in each of the frame members for adjusting the at least one worktable portion.

10. A foldable worktable according to claim 9, wherein said drive includes a spindle, a nut threadably engaged with the spindle and connected with an associated sliding block of the pair of sliding blocks so as to enable adjustment of at least one worktable portion.

11. A foldable worktable according to claim 10, wherein said support member is a U-shaped member mounted on the respective frame members so as to open in a downward direction.

12. A foldable worktable according to claim 11, wherein said locking pin is fastened to legs of the U-shaped member.

13. A foldable worktable according to claim 7, wherein both of said worktable portions are adjustably mounted along the frame members so as to enable a clamping of a workpiece between opposed edges of the worktable portions.

14. A foldable worktable according to claim 13, wherein each of said worktable portions are mounted on a pair of sliding blocks respectively accommodated in slots provided in the respective frame members.

15. A foldable worktable according to claim 14, wherein a drive is provided in each of the frame members for adjusting one of said worktable portions.

16. a foldable worktable according to claim 15, wherein said drive includes a spindle and a nut threadably engageable with the spindle and connected with an associated sliding block of the pair of sliding blocks.

17. A foldable worktable according to claim 15, wherein the other of said worktable portions is adjustable by a pawl and detent arrangement.

18. A foldable worktable according to claim 17, wherein the working surfaces of each of the worktable portions are fashioned so as to accommodate additional clamping devices.

19. A foldable worktable according to claim 7, wherein each of said worktable portions is mounted on a pair of sliding blocks respectively accommodated in a slot provided in the respective frame members, and wherein one of said worktable portions is secured on its associated sliding blocks with a radial play relative to the frame members and is adjustable diagonally with respect to the frame members.

20. A foldable worktable according to claim 7, wherein each of the sliding blocks includes a stepped bore for accommodating a sleeve shaped projection for enabling movement in the slot provided in the respective frame members, and wherein a head of a mounting fastener is provided in a widened portion of said stepped bore.

21. A foldable worktable according to claim 7, wherein each of the worktable portions includes a plurality of openings therein for accommodating individual clamping prisms for accommodating differently sized workpieces on the worktable portion.

* * * * *